US008970446B2

(12) United States Patent
Pascolini et al.

(10) Patent No.: US 8,970,446 B2
(45) Date of Patent: Mar. 3, 2015

(54) ELECTRONIC DEVICE WITH MAGNETIC ANTENNA MOUNTING

(75) Inventors: Mattia Pascolini, San Mateo, CA (US); Jerzy Guterman, Mountain View, CA (US); Jonathan Haylock, Los Angeles, CA (US); Jiang Zhu, Sunnyvale, CA (US); Peter Jeziorek, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 472 days.

(21) Appl. No.: 13/175,764

(22) Filed: Jul. 1, 2011

(65) Prior Publication Data

US 2013/0002517 A1 Jan. 3, 2013

(51) Int. Cl.

| | |
|---|---|
| ***H01Q 1/12*** | (2006.01) |
| ***H01Q 1/42*** | (2006.01) |
| ***H01Q 1/00*** | (2006.01) |
| ***H01Q 1/22*** | (2006.01) |

(52) U.S. Cl.

CPC ..... *H01Q 1/2258* (2013.01); *H01Q 1/2266* (2013.01)

USPC ..... 343/878; 343/872; 343/787

(58) Field of Classification Search

CPC ..... H01Q 1/2266

USPC ..... 343/878, 872, 787

See application file for complete search history.

(56) References Cited

U.S. PATENT DOCUMENTS

| | | | |
|---|---|---|---|
| 3,937,387 | A | 2/1976 | Fletcher et al. |
| 4,760,240 | A | 7/1988 | Iikawa et al. |
| 5,708,895 | A | 1/1998 | Ando et al. |
| 6,125,029 | A | 9/2000 | Sasaki et al. |
| 6,437,974 | B1 | 8/2002 | Liu |
| 6,574,096 | B1 | 6/2003 | DiFonzo et al. |
| 6,590,346 | B1 | 7/2003 | Hadley et al. |

(Continued)

FOREIGN PATENT DOCUMENTS

| | | |
|---|---|---|
| CN | 101241381 | 8/2008 |
| CN | 101783434 | 7/2010 |

(Continued)

OTHER PUBLICATIONS

Li, Qingxiang et al. U.S. Appl. No. 12/870,766, filed Aug. 27, 2010.

(Continued)

*Primary Examiner* — Jerome Jackson, Jr.

*Assistant Examiner* — Michael Bouizza

(74) *Attorney, Agent, or Firm* — Treyz Law Group; G. Victor Treyz; Jason Tsai

(57) ABSTRACT

An electronic device may have magnetically mounted antenna structures. The electronic device may have a dielectric member against which one or more antennas are mounted. The dielectric member may be a cover glass layer that covers a display in the electronic device, a dielectric antenna window, or other dielectric structure. Each antenna may have an antenna support structure. Conductive antenna structures for the antenna may be mounted to the antenna support structure. The antennas may be cavity-backed planar inverted-F antennas. Portions of each antenna support structure may be configured to receive magnets. The magnets may be attracted towards ferromagnetic structures mounted on the dielectric member. As the magnets are attracted towards the ferromagnetic structure, the antennas may be held in place against the dielectric member.

14 Claims, 15 Drawing Sheets

(56) References Cited

U.S. PATENT DOCUMENTS

| | | | | |
|---|---|---|---|---|
| 6,626,303 | B1 | 9/2003 | Moodie | |
| 7,075,487 | B2 * | 7/2006 | Mattsson et al. | 343/702 |
| 7,399,083 | B2 | 7/2008 | Bailey et al. | |
| 7,965,498 | B2 | 6/2011 | Gotham et al. | |
| 2001/0044320 | A1 | 11/2001 | Ono et al. | |
| 2003/0161142 | A1 | 8/2003 | Kotovsky | |
| 2004/0232291 | A1 | 11/2004 | Carnevali | |
| 2005/0284993 | A1 | 12/2005 | Ternus et al. | |
| 2007/0132910 | A1 | 6/2007 | Liao | |
| 2007/0291901 | A1 | 12/2007 | Warburton | |
| 2008/0063218 | A1 | 3/2008 | Weber et al. | |
| 2008/0247750 | A1 | 10/2008 | Law et al. | |
| 2009/0027583 | A1 * | 1/2009 | McBroom et al. | 349/58 |
| 2009/0040703 | A1 * | 2/2009 | Gotham et al. | 361/681 |
| 2009/0244853 | A1 | 10/2009 | Takahashi | |
| 2009/0246934 | A1 | 10/2009 | Yamazaki et al. | |
| 2009/0251372 | A1 * | 10/2009 | Degner et al. | 343/702 |
| 2009/0262029 | A1 * | 10/2009 | Chiang et al. | 343/702 |
| 2009/0266621 | A1 | 10/2009 | Huang et al. | |
| 2010/0073241 | A1 * | 3/2010 | Ayala Vazquez et al. | 343/702 |
| 2010/0073242 | A1 * | 3/2010 | Ayala Vazquez et al. | 343/702 |
| 2010/0171668 | A1 * | 7/2010 | Sun | 343/702 |
| 2010/0225612 | A1 | 9/2010 | Ishizaki et al. | |
| 2010/0315570 | A1 | 12/2010 | Mathew et al. | |
| 2011/0050508 | A1 * | 3/2011 | Guterman et al. | 343/702 |
| 2011/0075342 | A1 * | 3/2011 | Gotham et al. | 361/679.21 |

FOREIGN PATENT DOCUMENTS

| | | | | |
|---|---|---|---|---|
| CN | 202737088 | | 2/2013 | |
| JP | 2007003698 | * | 1/2007 | G02F 1/1333 |
| JP | 2008136105 | | 6/2008 | |
| JP | 2008137074 | | 6/2008 | |
| WO | 9505686 | | 2/1995 | |

OTHER PUBLICATIONS

McBroom et al., U.S. Appl. No. 11/829,845, filed Jul. 27, 2007.
Gotham et al., U.S. Appl. No. 13/107,808, filed May 13, 2011.
Catalano et al., U.S. Appl. No. 12/571,122, filed Sep. 30, 2009.

* cited by examiner

ELECTRONIC DEVICE WITH MAGNETIC ANTENNA MOUNTING

BACKGROUND

This relates generally to electronic devices and, more particularly, to electronic devices with antennas.

Electronic devices such as computers are often provided with antennas. For example, a computer monitor with an integrated computer may be provided with antennas that are located along an edge of the monitor.

Challenges can arise in mounting antennas within an electronic device. For example, the relative position between an antenna and surrounding device structures can have an impact on antenna tuning. If the position of an antenna is not well controlled, the antenna may become detuned.

It would therefore be desirable to be able to provide improved mounting arrangements for antennas in electronic devices.

SUMMARY

An electronic device may have magnetically mounted antenna structures. The electronic device may have a dielectric member against which one or more antennas are mounted. The dielectric member may be a cover glass layer that covers a display in the electronic device, a dielectric antenna window member, or other dielectric structure.

A ring-shaped ferromagnetic member may be mounted around the periphery of a cover glass layer or other dielectric member. The electronic device may have a housing in which a display is mounted. A channel may be formed between the walls of the housing and the display. Magnets may be mounted within the channel to attract the ferromagnetic member and thereby hold the cover glass on the housing.

Antennas may be mounted within part of the channel. For example, each antenna may be mounted between a pair of the magnets that are used in holding the cover glass to the housing. Each antenna may have an antenna support structure. The antenna support structure may be formed from a dielectric such as plastic. Conductive antenna structures for the antenna may be mounted to the antenna support structure. The shape of the antenna support structure and conductive antenna structures may be configured to form a cavity-backed planar inverted-F antenna.

Portions of each antenna support structure may be configured to receive magnets. The magnets may be attracted towards the ferromagnetic member that is mounted to the cover glass. As the magnets are attracted towards the ferromagnetic member, the antennas may be held in place against the cover glass member.

Further features of the invention, its nature and various advantages will be more apparent from the accompanying drawings and the following detailed description of the preferred embodiments.

DETAILED DESCRIPTION

Electronic devices may be provided with antennas and other wireless communications circuitry. The wireless communications circuitry may be used to support wireless communications in multiple wireless communications bands. One or more antennas may be provided in an electronic device. For example, antennas may be used to form an antenna array to support communications with a communications protocol such as the IEEE 802.11(n) protocol that uses multiple antennas.

Figure 1:
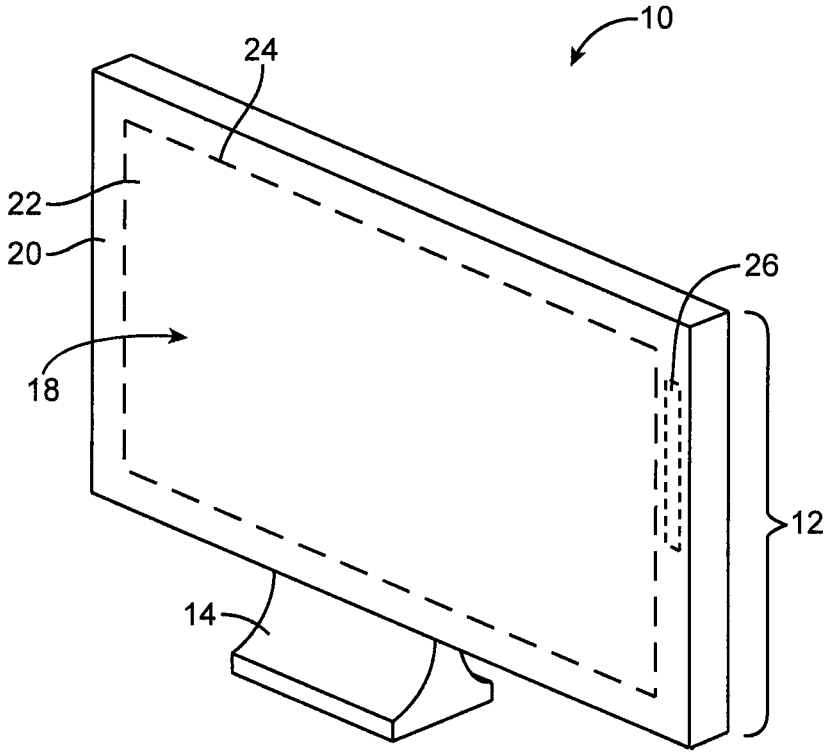
FIG. 1 is a perspective view of an illustrative electronic device with antenna structures in accordance with an embodiment of the present invention.

An illustrative electronic device of the type that may be provided with one or more antennas is shown in FIG. 1. Electronic device 10 may be a computer such as a computer that is integrated into a display such as a computer monitor. Electronic device 10 may also be a laptop computer, a tablet computer, a somewhat smaller device such as a wrist-watch device, pendant device, headphone device, earpiece device, or other wearable or miniature device, a cellular telephone, a media player, or other electronic equipment. Illustrative configurations in which electronic device 10 is a computer formed from a computer monitor are sometimes described herein as an example. In general, electronic device 10 may be any suitable electronic equipment.

Antennas may be formed in device 10 in any suitable location such as location 26. The antennas in device 10 may include loop antennas, inverted-F antennas, strip antennas, planar inverted-F antennas, slot antennas, cavity antennas, hybrid antennas that include antenna structures of more than one type, or other suitable antennas. The antennas may cover cellular network communications bands, wireless local area network communications bands (e.g., the 2.4 and 5 GHz bands associated with protocols such as the Bluetooth® and IEEE 802.11 protocols), and other communications bands. The antennas may support single band and/or multiband operation. For example, the antennas may be dual band antennas that cover the 2.4 and 5 GHz bands. The antennas may also cover more than two bands (e.g., by covering three or more bands or by covering four or more bands).

Conductive structures for the antennas may, if desired, be formed from conductive electronic device structures such as conductive housing structures, from conductive structures such as metal traces on plastic carriers, from metal traces in flexible printed circuits and rigid printed circuits, from metal foil, from wires, or from other conductive materials.

Device 10 may include a display such as display 18. Display 18 may be mounted in a housing such as electronic device housing 12. Housing 12 may be supported using a stand such as stand 14 or other support structure.

Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Display 18 may be a touch screen that incorporates capacitive touch electrodes or other touch sensor components or may be a display that is not touch sensitive. Display 18 may include image pixels formed from light-emitting diodes (LEDs), organic LEDs (OLEDs), plasma cells, electronic ink elements, liquid crystal display (LCD) components, or other suitable image pixel structures.

A cover glass layer may cover the surface of display 18. Rectangular active region 22 of display 18 may lie within rectangular boundary 24. Active region 22 may contain an array of image pixels that display images for a user. Active region 22 may be surrounded by an inactive peripheral region such as rectangular ring-shaped inactive region 20. The inactive portions of display 18 such as inactive region 20 are devoid of active image pixels. Display driver circuits, antennas (e.g., antennas in region 26), and other components that do not generate images may be located under inactive region 20.

The cover glass for display 18 may cover both active region 22 and inactive region 20. The inner surface of the cover glass in inactive region 20 may be coated with a layer of an opaque masking material such as opaque plastic (e.g., a dark polyester film) or black ink. The opaque masking layer may help hide internal components in device 10 such as antennas, driver circuits, housing structures, mounting structures, and other structures from view.

The cover layer for display 18, which is sometimes referred to as a cover glass, may be formed from a dielectric such as glass or plastic. Antennas mounted in region 26 under an inactive portion of the cover glass may transmit and receive signals through the cover glass. This allows the antennas to operate, even when some or all of the structures in housing 12 are formed from conductive materials. For example, mounting the antenna structures of device 10 in region 26 under part of inactive region 20 may allow the antennas to operate even in arrangements in which some or all of the walls of housing 12 are formed from a metal such as aluminum or stainless steel (as examples).

Figure 2:
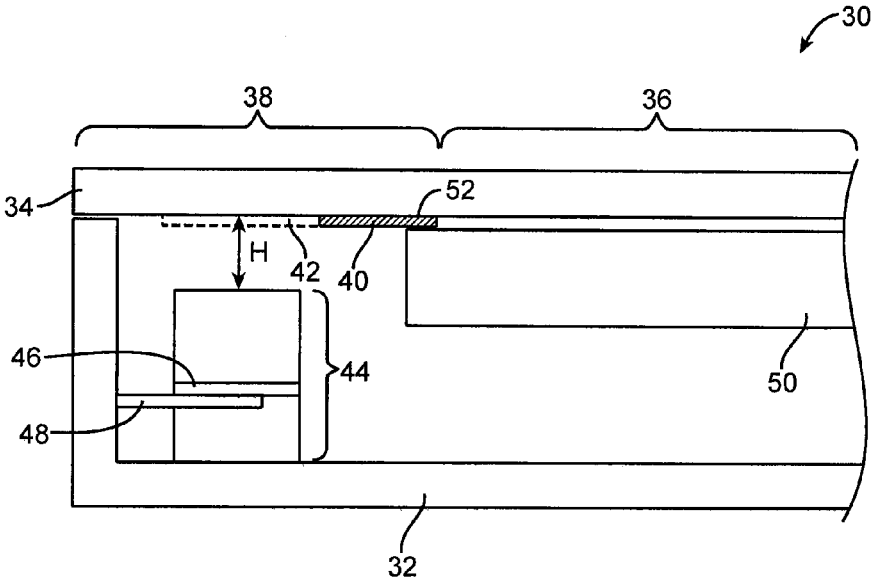
(PRIOR ART) FIG. 2
FIG. 2 is a cross-sectional side view of a conventional mounting arrangement for an antenna in a computer with a display.

A conventional arrangement for mounting an antenna under an inactive display region in a computer is shown in FIG. 2. As shown in the cross-sectional side view of FIG. 2, liquid crystal display module 50 is mounted under cover glass 34 in housing 32 of computer 30. Active display region 36 is associated with display module 50. The underside of cover glass 34 is coated with black masking material 52 in inactive display region 38. Ring-shaped peripheral metal strip 40 surrounds the rectangular periphery of display 50 under inactive region 38. Rectangular openings such as opening 42 are formed in metal strip 40 to accommodate antennas such as cavity antenna 44. Using structures 46 on cavity antenna 44, cavity antenna 44 is mounted to mounting structure 48 on housing 32 at a distance H below cover glass layer 34.

As shown in FIG. 2, cover glass 34 rests on the edge of housing 32. As a result, the position of cover glass 34 may be accurately fixed with respect to housing 32. Although cover glass 34 is registered to housing 32, antenna 44 is mounted to housing 32 using components that are subject to manufacturing variations such as structures 46 and 48. Manufacturing variations that affect the size and shape of housing 32 and components 46 and 48 can lead to undesired variations in distance H. These variations in the distance at which the dielectric of cover glass 34 lies from antenna 44 can create corresponding variations in the performance of antenna 44. For example, shifts in antenna position relative to cover glass 34 of about 1 to 2 mm due to manufacturing variations can detune antenna 44 enough to result in undesired shifts in antenna frequency response of about 100 MHz.

Figure 3:
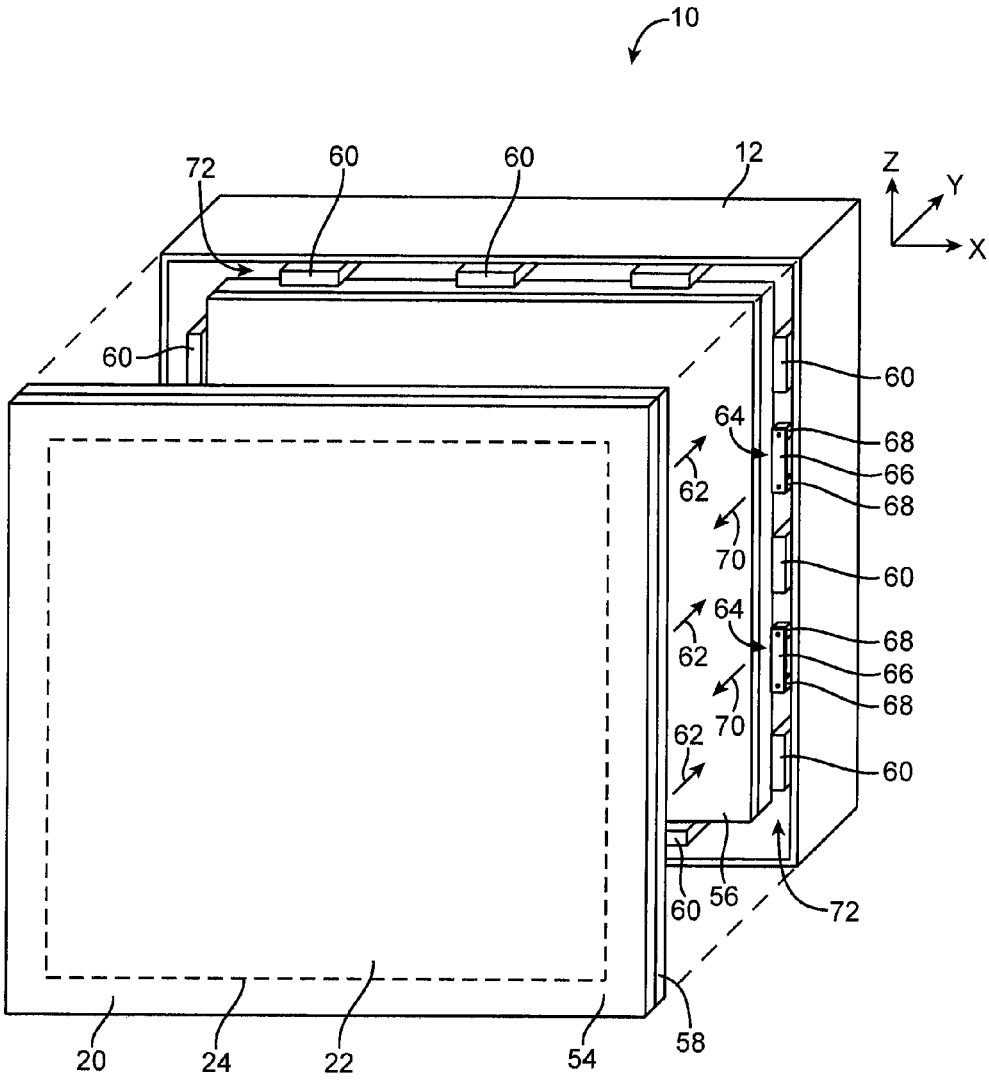
FIG. 3 is an exploded perspective view of an illustrative electronic device of the type that may be provided with magnetically mounted antenna structures in accordance with an embodiment of the present invention.

An antenna mounting arrangement of the type that may be used to address these concerns is shown in FIG. 3. As shown in the exploded perspective view of FIG. 3, electronic device 10 (e.g., a computer formed by integrating computer circuitry into a computer monitor housing or other device of the type described in connection with FIG. 1), may have a display module such as display module 56 mounted in a housing such as housing 12. Cover glass 54 (e.g., a layer of glass, plastic, or other suitable transparent cover layer material) may cover display module 56. Display module 56 may be a liquid crystal display (LCD) display module, an organic light-emitting diode (OLED) display module, a plasma display, or other suitable display structure. When cover glass 54 is mounted on housing 12, display 56 may produce images in active display region 22 (bounded by rectangular dashed line 24). The edge of display 56 may not extend substantially into inactive display region 20 of cover glass 54.

If desired, the underside of inactive display region 20 may be coated with an opaque masking layer such as a layer of black plastic or ink or other opaque structures. Some or all of the interior surface of inactive region 20 may also be covered with a ring-shaped peripheral ferromagnetic member such as ferromagnetic member 58. Member 58 may be formed from one or more strips of stainless steel or other suitable ferromagnetic metals and may be attached to the interior surface of cover glass 54 in inactive region 20 using adhesive or other suitable attachment mechanisms.

The space between the sidewalls of housing 12 and display module 56 may form a peripheral channel such as channel 72 that surrounds display module 56 and that is surrounded by the sidewalls of housing 12. Magnets such as magnets 60 may be mounted in channel 72 (e.g., using adhesive, mounting brackets, recesses in housing 12, other mounting structures connected to housing 12, etc.). There may be any suitable number of magnets 60 in channel 72 (e.g., one, two, three, four, five or more, etc.). With one suitable arrangement, 5-30 magnets 60 may be distributed around the periphery of housing 12 (as an example).

When cover glass 54 is placed in the vicinity of housing 12, magnets 60 will tend to attract ferromagnetic structures 58 in direction 62 against housing 12 and will thereby help to hold cover glass 54 in place on housing 12. The use of magnets 60 may allow cover glass 54 to be mounted on display 12 without need to use potentially unsightly fasteners on the exterior surface of cover glass 54. If desired, other types of mechanisms may be used for attaching cover glass 54 to housing 12 (e.g., mating engagement features, springs, clips, fasteners in the interior of device housing 12, etc.).

Antenna structures such as one or more antennas 66 may be mounted within one or more of channels 72. In the FIG. 3 example, a pair of antennas 66 has been mounted in the channel that is located along the right-hand edge of housing 12. If desired, fewer than two antennas 66 or more than two antennas 66 (e.g., three or more antennas 66, four or more antennas 66, etc.) may be mounted in the right-hand channel 72. One or more antennas 66 may also be mounted in one or more other channels 72. The arrangement of FIG. 3 in which antennas 66 are mounted in a channel 72 on the right-hand side of device 10 is merely illustrative.

Antennas 66 may be cavity-backed antennas or other suitable antennas. Antennas 66 may be, for example, cavity-backed planar inverted-F antennas. With this type of arrangement, a cavity such as a box-shaped cavity may be formed from conductive (ground plane) metal wall structures that surround a plastic support or other antenna carrier structure. The cavity may have an open top that faces the underside of cover glass 58. Conductive antenna structure (e.g., patterned metal structures forming a planar inverted-F antenna resonating element structure or other antenna resonating element structure) may be formed within the opening. The presence of the cavity walls on the sides and bottom of the cavity will tend to isolate the antenna from surrounding conductive structures such as parts of display module 56 and housing 12. This may help improve antenna performance consistency. The presence of the cavity opening facing the underside of cover glass 58 will tend to focus the operation of the antenna outwards through the dielectric of cover glass 58 in inactive region 20. If desired, antennas 66 may use other types of antenna configurations. The use of cavity-backed antennas in implementing antennas 66 is merely illustrative.

To accurately position antennas 66 relative to their environment, antennas 66 may be provided with magnetic structures such as magnetic structures 68. Structures 68 may pull antennas 66 in direction 70 so that antennas 66 rest against the underside of cover glass 54 or structures that are attached to cover glass 54. Other biasing structures such as foam or springs that push antennas 66 in direction 70 may be used, if desired, although such structures may tend to compete with the attractive force from magnets 60 that is attempting to hold cover glass 54 in place on housing 12.

The registration of antennas 66 against cover glass 54 helps to ensure that the separation between the antenna resonating element structures in antennas 66 and the dielectric material of cover glass 54 is well controlled. By accurately controlling the distance between antenna 66 and cover glass 54, manufacturing variations that may potentially influence the tuning of antennas 66 may be reduced. This may make it possible to improve antenna performance and/or reduce antenna size (e.g., by allowing a narrow-band antenna design to be used).

Figure 4:
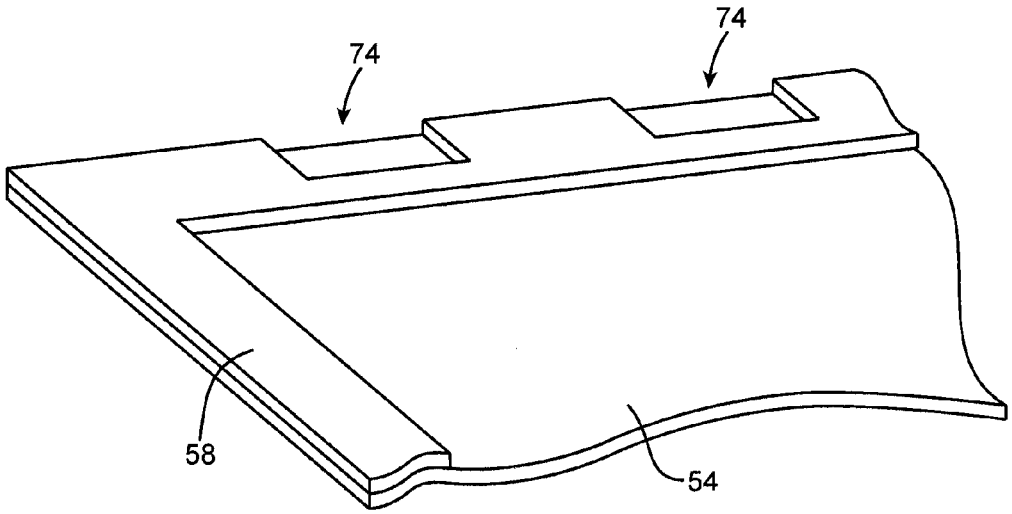
FIG. 4 is a perspective view of an interior surface of a portion of a display cover glass that has been provided with a peripheral ring-shaped strip of a ferromagnetic material with openings for antennas in accordance with an embodiment of the present invention.

A portion of the interior surface of an illustrative cover glass structure is shown in FIG. 4. As shown in FIG. 4, ferromagnetic structures 58 may be formed around the rectangular periphery of cover glass 54. Ferromagnetic structure 58 may, for example, be formed in a peripheral rectangular ring shape. Openings 74 may be formed in ferromagnetic structures 58 to accommodate antennas 66. Antennas 66 may be biased towards cover glass 54 in regions 74 by ferromagnetic structures 58. Openings 74 are devoid of conductive materials such as metal. The open face of the antenna cavity and the antenna resonating element in each antenna 66 may be positioned so as to overlap with a respective one of openings 74. During operation, radio-frequency antenna signals may therefore be conveyed to and from antennas 60 through the portions of cover glass 54 within openings 74. Magnetic structures 68 may be positioned so as to overlap with ferromagnetic structures 58, so that antennas 66 are biased towards cover glass 54.

Figure 5:
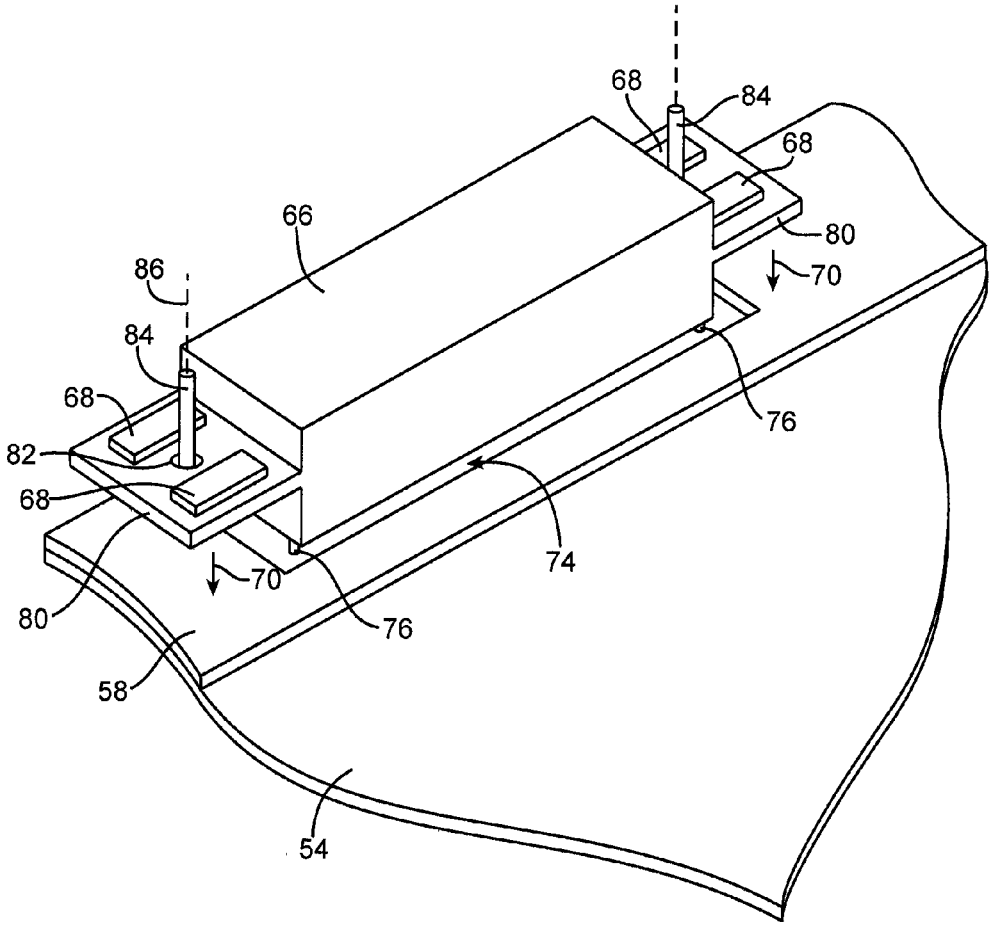
FIG. 5 is a perspective view of an interior surface of a portion of a display cover glass of the type shown in FIG. 4 in which an antenna has been mounted in an opening in the ferromagnetic material using magnets in accordance with an embodiment of the present invention.

FIG. 5 is a perspective view of an interior portion of device 10 showing how an antenna may be mounted over an opening such as opening 74 of FIG. 5 using magnetic structures. As shown in FIG. 5, antenna 66 may have portions such as structures 80 on which magnetic structures 68 are mounted. Antenna 66 may be formed from a dielectric support structure such as an injection molded plastic member. Structures 80 may be protruding structures such as tabs or other suitable structures that serve as mounting structures for magnetic structures 68. Structures 80 may extend outwardly from the ends of an injection molded plastic member or other support structure sufficiently that magnetic structures 68 overlap ferromagnetic structures 58.

Magnetic structures 68 may be formed from one or more magnets. Portions 80 of antenna 66 (i.e., the protruding end portions of the plastic support for antenna 66) may have features such as openings 82 that receive guiding structures such as guiding members 84. Guiding structures 84 may be elongated members such as threaded screws that are characterized by longitudinal axes 86. Openings 82 may be sufficiently large to allow antenna 66 to slide up and down along guiding structures 84.

Antenna 66 (i.e., the dielectric support structure for antenna 66) may be provided with features such as protrusions 76 or other structures that support antenna 66 when antenna 66 comes to rest against cover glass 54 (or against structures that are mounted to cover glass 54). Protrusions 76 may be configured so as to accurately define the distance between the conductive antenna structures that make up the antenna and cover glass 54. Magnetic structures 68 will tend to attract ferromagnetic structures 58, which will bias antenna 66 towards cover glass 54. When biased in this way, protrusions 76 of antenna 66 will contact cover glass 54 (or structures that are mounted to cover glass 54). The distance between protrusions 76 and the antenna resonating element portion of antenna 66 can be well controlled during manufacturing, so this arrangement will allow accurate control of the distance between antenna 66 and cover glass 54. Accurate control of the separation between antenna 66 and cover glass 54 may help ensure that antenna 66 performs accurately and is not unduly influenced by manufacturing variations.

In the example of FIG. 5, antenna 66 has magnetic structure mounting structures 80 that protrude from opposing ends of an elongated antenna support structure. Other types of arrangements may be used such as arrangements with fewer than two or more than two guiding structures 84, with fewer than two or more than two protruding portions such as structures 80, etc. The arrangement of FIG. 5 is merely illustrative.

Figure 6:
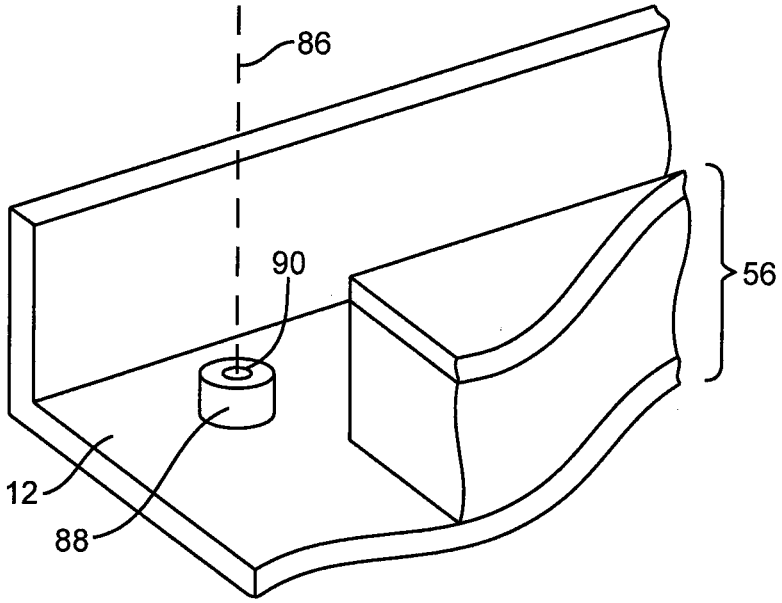
FIG. 6 is a perspective view of a portion of an electronic device housing showing how the housing may be provided with a feature that receives a post or other guiding structure for guiding an antenna in accordance with an embodiment of the present invention.

As shown in FIG. 5, guiding structure 84 may be formed using an elongated member that protrudes through antenna carrier 66 (i.e., through opening 82 in structures 80) along axis 86. Housing 12 may be provided with an integral or attached structure for receiving the tip of guiding structure 84. For example, housing 12 may be provided with a structure such as structure 88 of FIG. 6 that has an opening such as opening 90 for receiving the tip of guiding structure 84. The tip of guiding structure 84 may be cylindrical and may be threaded (e.g., guiding structure 84 may be a screw or other threaded shaft). Opening 90 may form a mating threaded cylindrical bore in structure 88. With this type of arrangement, guiding structure 84 may be attached to housing 12 by screwing guiding structure 84 into opening 90. Guiding structure 84 may also be implemented using a thread-free shaft configuration (e.g., a press-fit pin), if desired.

Figure 7:
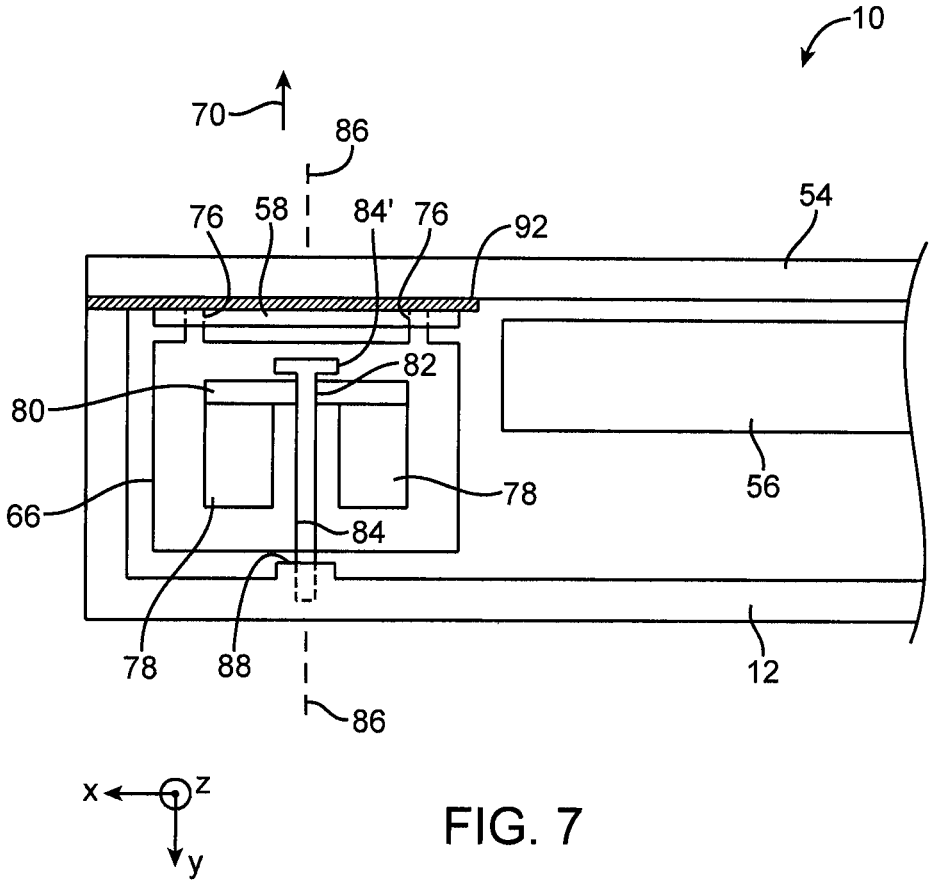
FIG. 7 is a cross-sectional side view of a portion of an illustrative electronic device with magnetically mounted antenna structures in accordance with an embodiment of the present invention.

When mounted in device 10, antenna 66 may be configured as shown in FIG. 7. Antenna 66 may have a portion such as portion 80 that has an opening such as opening 82. Guiding structure 84 may be a screw that is screwed into structure 88 on housing 12. Head 84' of guiding structure 84 may capture portion 80 and antenna 66. Magnetic structures 68 such as one or more magnets on either end of antenna 66 may be attached to portion 80 and may be used to pull antenna 66 towards cover glass 54 in direction 70 until protrusions 76 come to rest on cover glass 54 or come to rest on structures that are attached to cover glass (e.g., on opaque masking material 92 or on structures that are mounted against material 92).

Figure 8:
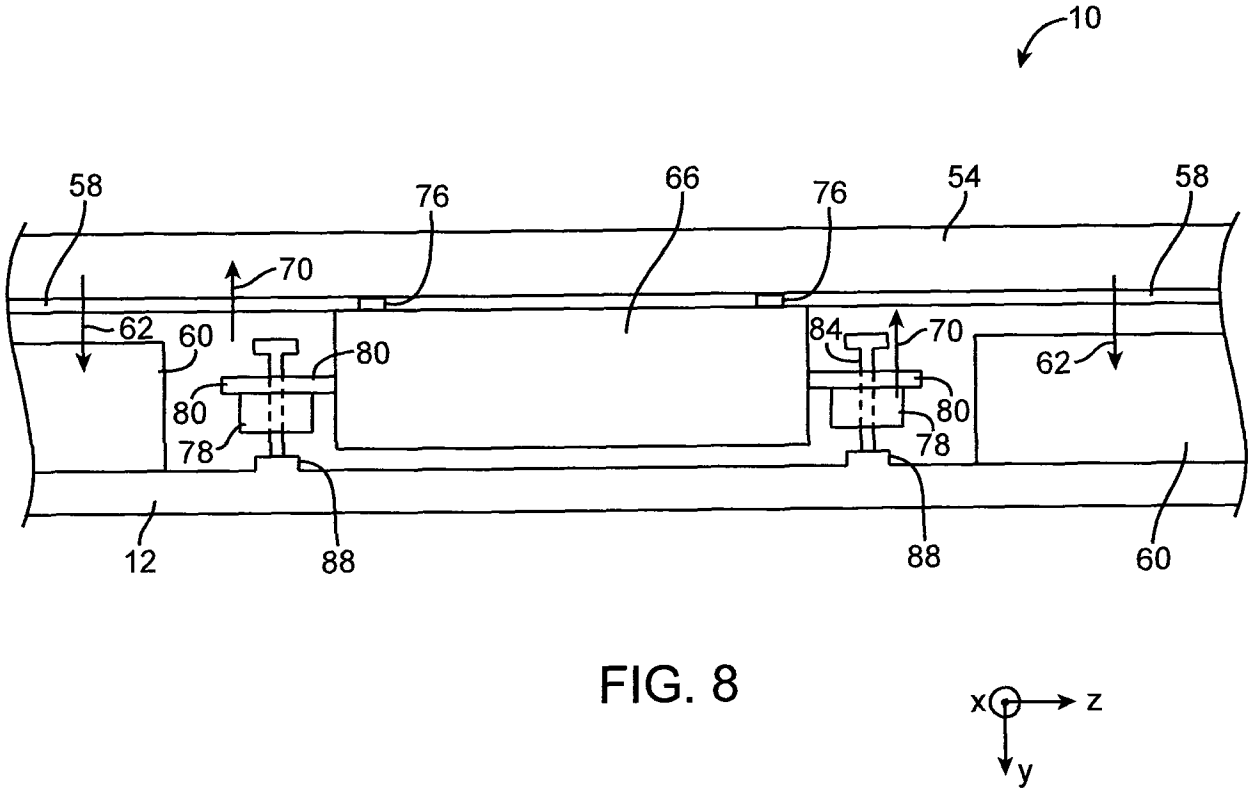
FIG. 8 is a cross-sectional view of a portion of an illustrative electronic device showing magnets for mounting antenna structures and magnets for holding a display cover glass layer in place on the electronic device in accordance with an embodiment of the present invention.

A cross-sectional side view of an antenna mounted in device 10 using magnetic structures 68 is shown in FIG. 8. As shown in FIG. 8, magnets 60 may be attached to housing 12 and, through their attraction to ferromagnetic material 58, can pull housing 12 towards material 58 and cover glass 54 in direction 70 while pulling material 58 and cover glass 54 towards housing 12 in direction 62. Antenna 66 may be free to move along guide structures 84. Magnetic structures 78 are attracted to ferromagnetic material 58 and therefore pull antenna portions 80 and the rest of antenna 66 towards cover glass 58 in direction 70, until portions 76 of antenna 66 contact cover glass 54 (or contact structures mounted to cover glass 54).

Figure 9:
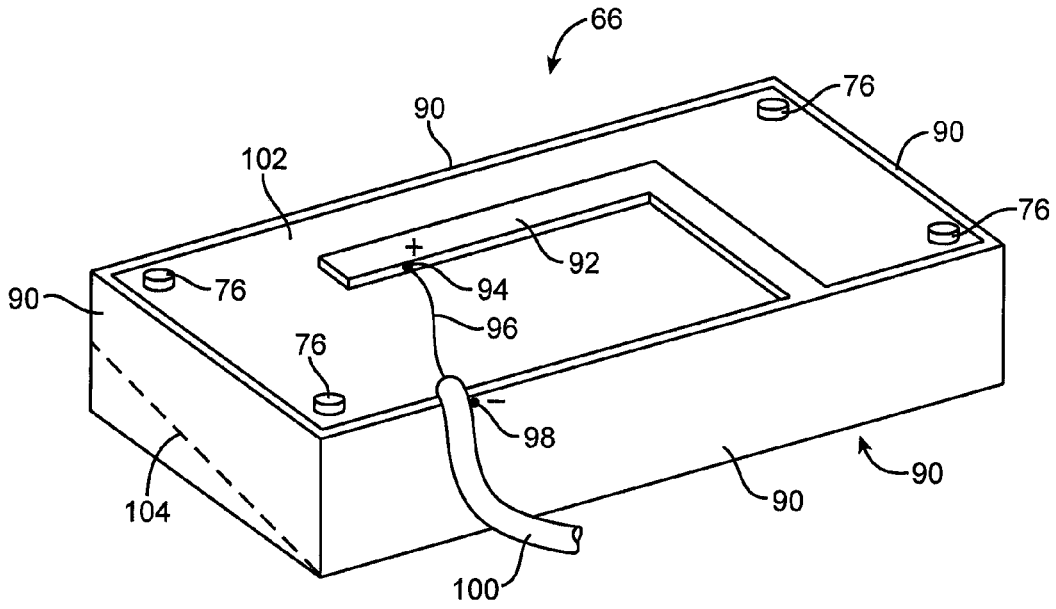
FIG. 9 is a perspective view of an antenna having a conductive cavity and antenna resonating element traces mounted on a plastic support structure in accordance with an embodiment of the present invention.

FIG. 9 is a perspective view of an illustrative antenna. As shown in FIG. 9, antenna 66 may have a support structure such as antenna support structure 102. Protrusions 76 may be formed as an integral portion of antenna support structure 102 or may be mounted to support structure 102. Protrusions 80 (FIG. 8) may be attached to the surface of rectangular structures shown in FIG. 9 or may be formed as an integral portion of those structures. Antenna support structures 102 may be hollow or solid and may be formed from injection-molded plastic, machined plastic, glass, ceramic, or other suitable dielectric materials. Support structures 102 may be formed form a single unitary piece of material or may be formed from multiple structures that are attached using fasteners, adhesive, or other attachment mechanisms.

Conductive antenna structures may be formed on antenna support structure 102 to form antenna 66. The conductive structures may include conductive antenna resonating element structure 92 and conductive antenna cavity walls 90. Structures such as structure 92 and structures such as walls 90 may be formed using metal or other conductive materials.

Conductive structure 92 may be patterned to form an antenna resonating element such as an inverted-F antenna resonating element for antenna 66. Antenna 66 may be fed at an antenna feed formed from positive antenna feed terminal 94 and ground antenna feed terminal 98. Transmission line 100 may be coupled between the feed for antenna 66 and a radio-frequency transceiver (e.g., a dual band IEEE 802.11 transceiver, a cellular telephone transceiver, etc.). Transmission line 100 may have a positive conductor such as conductor 96 that is coupled to positive antenna feed terminal 94 and may have a ground conductor such as an outer braid on transmission line 100 that is coupled to ground feed terminal 98. Transmission line 100 may be implemented using a coaxial cable. Other types of transmission line paths (e.g., microstrip transmission lines, stripline transmission lines, edge coupled microstrip transmission lines, edge coupled stripline transmission lines, etc.) may be used for implementing some or all of transmission line 100 if desired.

Conductive cavity structures 90 on the outer surfaces of structure 102 may be formed from planar metal layers and may be used in forming an antenna cavity for cavity-backed antenna 66. Structures 90 may include planar sidewall structures on the sides of support structure 102 and may include a planar layer on the rear surface of structure 102. The upper surface of support structure 102 may be open (i.e., the cavity may face upwards in the orientation shown in FIG. 9). Antenna resonating element 92 (e.g., an inverted-F antenna resonating element or other suitable antenna resonating element) may be formed within the opening at the top of the cavity formed from cavity wall structures 90.

In the example shown in FIG. 9, structure 102 has a box shape, so the cavity that backs resonating element 92 has a box shape with an opening in its upper (outermost) face. If desired, some or all of the surfaces of structure 102 may be curved (see, e.g., curved dashed line 104, which illustrates how the rear wall of the cavity formed by structures 90 may be curved). The use of curved walls for the antenna cavity may help antenna 66 fit into a device with a curved wall for housing 12.

Figure 10:
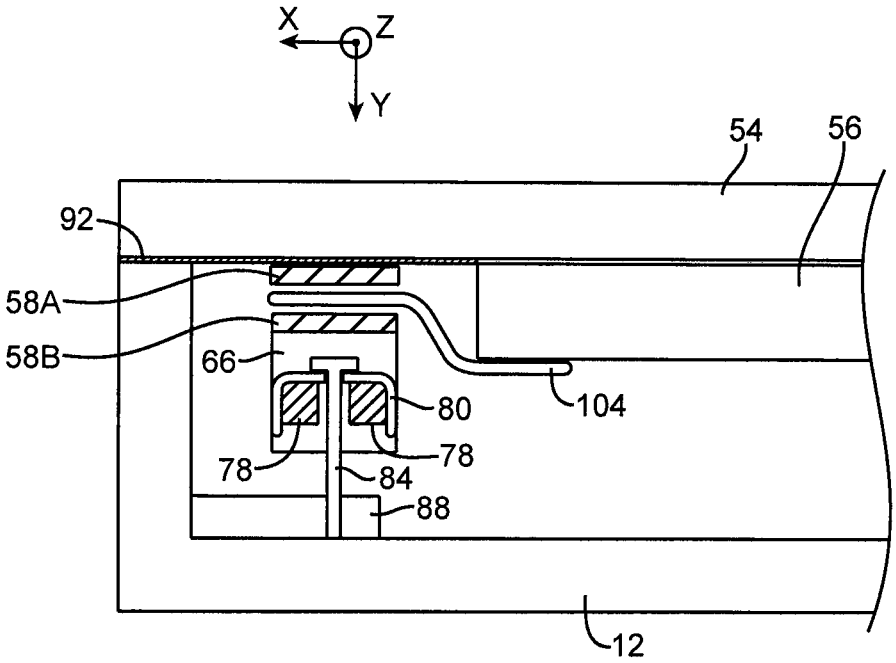
FIG. 10 is a cross-sectional side view of a portion of an electronic device in which antennas have been magnetically mounted in accordance with an embodiment of the present invention.

FIG. 10 is a cross-sectional side view of a portion of an illustrative embodiment for device 10. In the example of FIG. 10, magnetic structures 78 have been mounted under a protruding portion of antenna 66 (protruding portion 80) that has recesses for receiving magnetic structures 78. Magnetic structures 78 may be formed from one or more magnets. As shown in FIG. 10, display 56 may be mounted within housing 12 using mounting structures such as mounting structures 104 (e.g., an aluminum chassis or other support structure). Adhesive may be used to attach ferromagnetic structures 58 and/or mounting structures 104 to adjacent structures such as cover glass 54. In this type of arrangement, some of mounting structures 104 may be interposed between ferromagnetic structures 58 and cover glass 54 or, if desired, ferromagnetic structures 58 may be interposed between mounting structures 104 and cover glass 54. These two possible locations for ferromagnetic structures 58 are illustrated in FIG. 10 as locations 58A and 58B. Openings in ferromagnetic structures 58 such as openings 74 (FIG. 4) may remain free of metal from structures 104.

Figure 11:
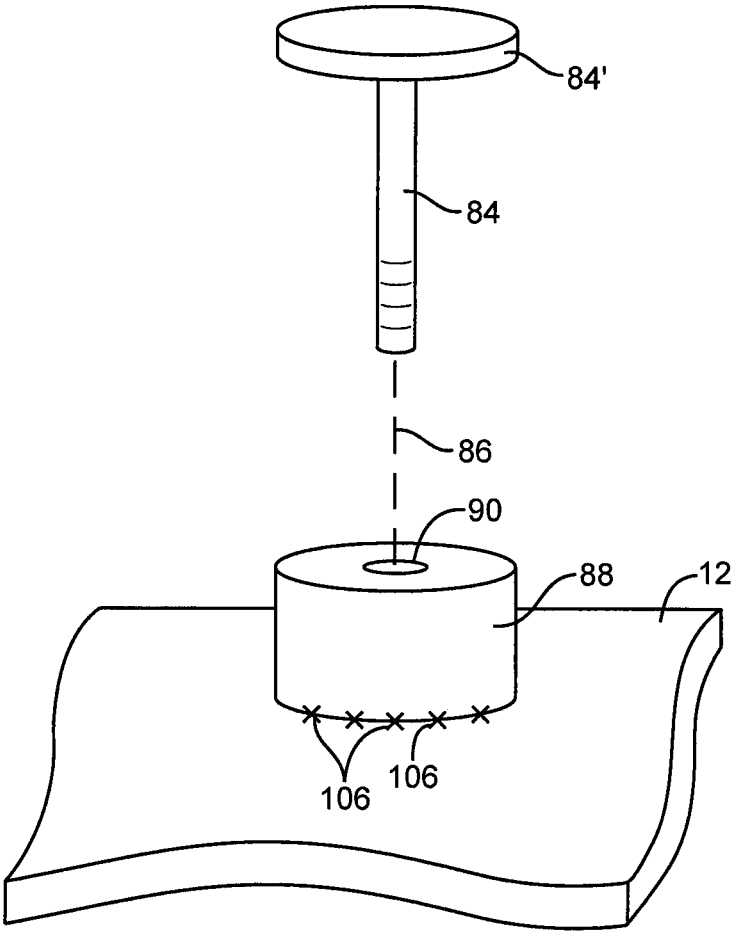
FIG. 11 is a perspective view showing an illustrative housing structure that may be used to receive an antenna structure guiding member such as a guide post in accordance with an embodiment of the present invention.

FIG. 11 is a perspective view of an illustrative configuration that may be used for mounting guiding structure 84 to housing 12. As shown in FIG. 11, structure 88 may be implemented using a nut that is welded to housing 12 using welds 106. Guiding structure 84 may be a threaded shaft that is adapted to screw into threaded opening 90 in the nut.

Figure 12:
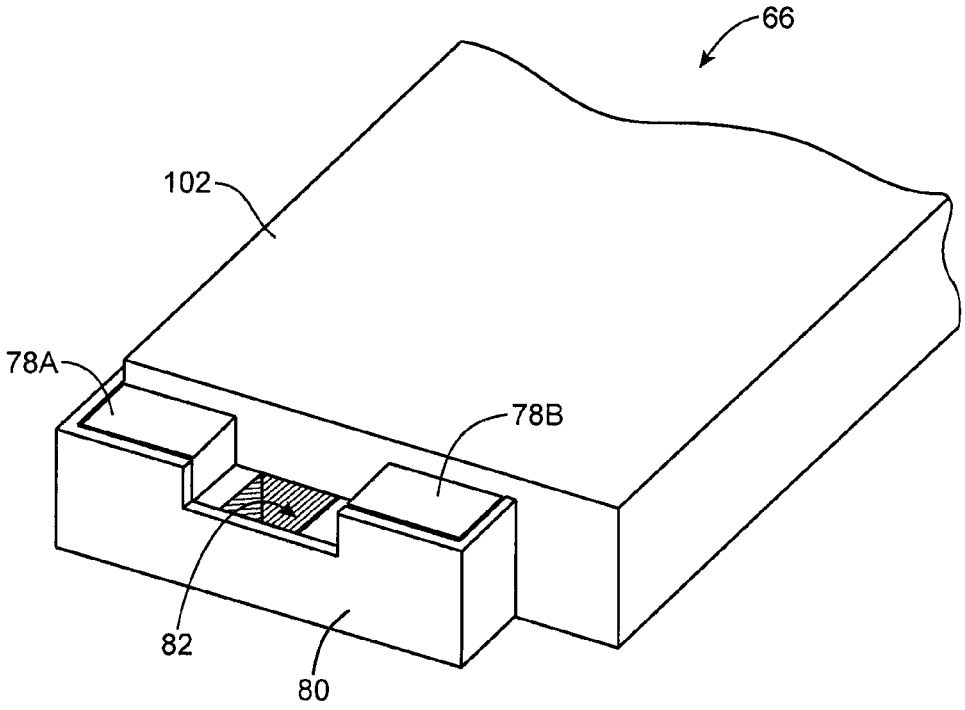
FIG. 12 is a perspective view of an illustrative antenna structures having recesses that receive magnets for mounting the antenna structures within an electronic device in accordance with an embodiment of the present invention.

FIG. 12 is a perspective view of an illustrative support structure arrangement that may be used for antenna 66. As shown in FIG. 12, support structure 102 may have portions such a structures 80 that contains recesses into which magnetic structures 78 such as magnets 78A and 78B may be mounted. Magnets 78A and 78B may be attached to structures 80 of antenna support structure 102 by press fitting magnets 78A and 78B into the recesses in structures 80, using adhesive, using fasteners, or using other suitable attachment mechanisms. Magnets 78A and 78B may have bevels and other surface features to engage with the sidewall shape or other desired shape of housing 12.

Figure 13:
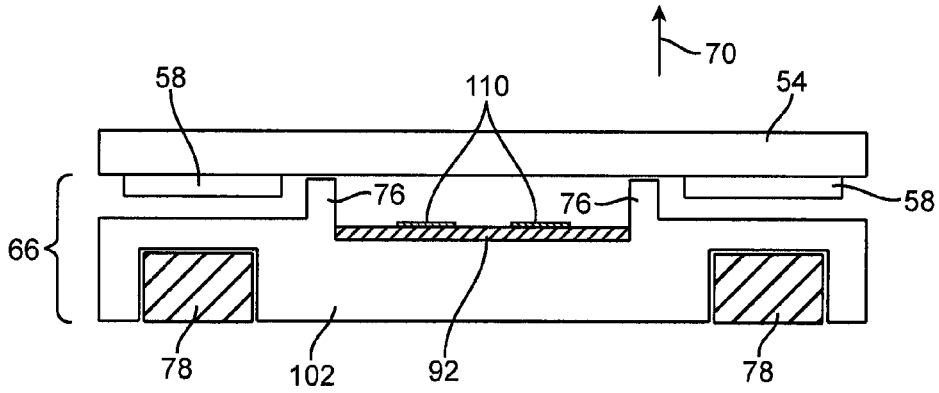
FIG. 13 is a cross-sectional side view of an illustrative antenna having an antenna resonating element formed from a structure such as a flex circuit that is magnetically mounted to a dielectric member such as a cover glass layer in accordance with an embodiment of the present invention.

FIG. 13 is a cross-sectional side view of an illustrative antenna mounting arrangement for device 10 in which antenna 66 has been formed using an antenna resonating element (shown as element 92) that is mounted on a recess in antenna support structure 102. Magnetic structures 78 may be mounted in recesses or other structures in support structure 102 and may pull antenna 66 against a structure such as cover glass 54 or other dielectric member in direction 70 due to magnetic attraction between magnetic structures 78 and ferromagnetic structures 58.

Antenna resonating element 92 may include patterned metal traces such as metal traces 110 (e.g., traces that form an inverted-F antenna resonating element, a patch antenna, a single-band antenna, a dual-band antenna, an antenna that covers more than two communications bands, an L-shaped antenna resonating element, or other antenna resonating element). Metal traces 110 may be formed on a plastic substrate (e.g., a plastic support structure such as support structure 102), may be formed in a flexible printed circuit ("flex circuit") formed from a sheet of flexible polymer such as a layer of flexible polyimide, may be formed using stamped metal foil, wires, or other conductive antenna resonating element structures. Structures such as protrusions 76 may be formed in antenna mounting structure 102. When structures 102 are pulled against cover glass 54 by the magnetic attraction between ferromagnetic structures 58 and magnetic structures 78, protrusions 76 may rest against cover glass 54 and may help accurately define the distance between antenna resonating element 92 and cover glass 54. In antenna 66 of FIG. 13 and in other antennas 66 such as antenna 66 of FIG. 5, the positions of ferromagnetic structures 58 and magnetic structures 78 may, if desired, be reversed.

Figure 14:
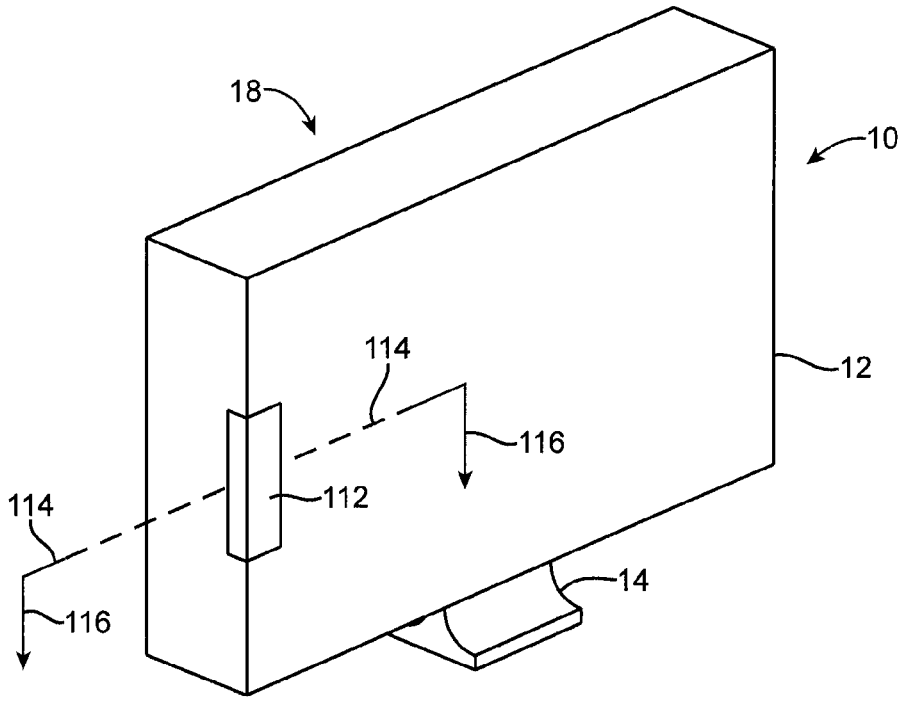
FIG. 14 is a rear perspective view of an illustrative electronic device with antenna structures in accordance with an embodiment of the present invention.

FIG. 14 is a rear perspective view of device 10 in an illustrative configuration in which housing 12 has been provided with an antenna window. In the FIG. 14 example, the walls of housing 12 may be implemented using a conductive material such as metal. To accommodate radio-frequency antenna signals, one or more antennas for device 10 may be mounted under a dielectric window structure such as dielectric antenna window 112. Antenna window 112 may, for example, be formed from a plastic member, a glass member, a ceramic member, or other dielectric structures that are mounted in an opening within the metal walls of housing 12. During wireless operation, radio-frequency signals may be received by an antenna in device 10 through antenna window 112 and radio-frequency signals may be transmitted from an internal transmitter to external equipment through antenna window 112.

In scenarios of the type shown in FIG. 14 in which the rear of housing 12 is substantially planar, window 112 may be implemented using a flat or slightly bent sheet of plastic or other planar dielectric member. In general, housing 12 and window 112 may have any suitable shapes (flat, curved, etc.). The shape of antenna 66 may be configured to mate with the shape of the inner surface of the member. For example, if the inner surface of antenna window 112 is flat, the surface of antenna 66 may be flat and if the inner surface of antenna window 112 is curved, the surface of antenna 66 may be curved.

Figure 15:
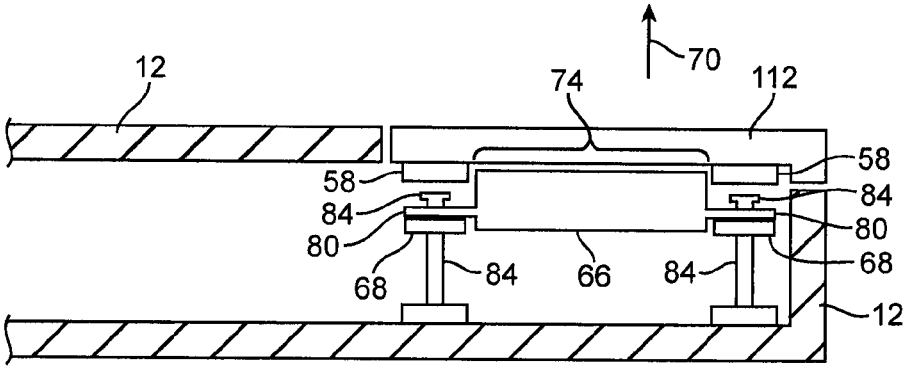
FIG. 15 is a cross-sectional side view of an antenna that has been magnetically mounted under a dielectric antenna window in an electronic device with conductive housing walls in accordance with an embodiment of the present invention.

FIG. 15 is a cross-sectional side view of device 10 of FIG. 14 taken along line 114 of FIG. 14 and viewed in direction 116. As shown in FIG. 15, ferromagnetic structures 58 may be mounted to the inner surface of antenna window structure 112. Adhesive, screws, other fasteners, or other attachment mechanisms may be used in attaching structures such as ferromagnetic structures 58 to antenna window structure 112.

In the illustrative example of FIG. 15, ferromagnetic structures 58 have been formed in a ring or other pattern in which some of structures 58 are located at one end of antenna 66 and some of structures 58 are located at another end of antenna 66. Ferromagnetic structures 58 may have an opening such as opening 74 to accommodate antenna 66. Other antenna window structures 112 and arrangements for attaching ferromagnetic structures 58 to antenna window structures 112 may be used if desired.

Antenna 66 may be formed from a plastic carrier such as carrier 102 of FIG. 9 and may have cavity walls such as walls 90 of FIG. 9. The cavity walls may form an antenna cavity for antenna 66. An antenna resonating element such as antenna resonating element 92 of FIG. 9 (e.g., an inverted-F antenna resonating element) may be formed in an opening at the top of the cavity formed by walls 90.

As shown in FIG. 15, antenna 66 may have protruding structures such as structures 80. Structures 80 may protrude from the ends of antenna 66, so as to overlap ferromagnetic structures 58. Magnetic structures 68 may be mounted to structures 80 by press fitting structures 68 into recesses in structures 80, by attaching structures 68 to structures 80 using adhesive, using fasteners, or using other attachment mechanisms.

Guiding structures 84 may be implemented using screws or other suitable structures that mate with structures such as structures 88 on housing 12. Structures 88 may be, for example, threaded nuts that have been welded to housing 12 as described in connection with structure 88 of FIG. 11. Protruding portions 80 of antenna 66 and magnetic structures 68 may be provided with openings that receive guiding structures 84 or may otherwise be configured to accommodate guiding structures 84. Guiding structures 84 may help control the lateral position of antenna 66 under antenna window 112 while allowing antenna 66 to move vertically (e.g., in direction 70) relative to housing 12 and antenna window 112.

Due to the magnetic attraction between magnetic structures 68 and ferromagnetic structures 58, antenna 66 may be biased outwards in direction 70 so that the outer surface of antenna 66 contacts the adjacent inner surface of dielectric window 112. The biasing provided to antenna 66 by the attraction between magnetic structures 68 and ferromagnetic structures 58 helps to hold antenna 66 in place against antenna window 112. By controlling the location of antenna 66 with respect to nearby structures such as dielectric antenna window 112, antenna detuning due to manufacturing variations can be minimized.

The foregoing is merely illustrative of the principles of this invention and various modifications can be made by those skilled in the art without departing from the scope and spirit of the invention.

What is claimed is:

1. An electronic device having an interior and an exterior comprising:

a display cover layer having an internal surface at the interior of the device and an external surface at the exterior of the device;

magnetic structures; and an antenna that is biased against the display cover layer by the magnetic structures, wherein the antenna is biased against the internal surface of the display cover layer.

2. The electronic device defined in claim 1 wherein the antenna comprises a plastic support structure to which the magnetic structures are mounted.

3. The electronic device defined in claim 1 wherein the antenna comprises a cavity-backed planar inverted-F antenna.

4. The electronic device defined in claim 1 further comprising:

a display module; and a housing in which the display module and the antenna are mounted, wherein the display cover layer covers the display module.

5. The electronic device defined in claim 4 further comprising a ferromagnetic structure attached to the display cover layer.

6. The electronic device defined in claim 1 wherein the antenna comprises a dielectric support member with at least one portion to which the magnetic structures are mounted and at least one portion that supports conductive antenna resonating element structures.

7. The electronic device defined in claim 6 further comprising guiding structures that guide the antenna as the antenna moves relative to the housing when biased by the magnetic structures.

8. The electronic device defined in claim 7 wherein the guiding structures comprise at least one elongated member that passes through an opening in the antenna.

9. The electronic device defined in claim 1 wherein the antenna comprises a flex circuit antenna resonating element.

10. The electronic device defined in claim 1 wherein the antenna comprises metal structures on a plastic support structure and wherein the plastic support structure has protrusions that rest against the display cover layer.

11. An electronic device comprising:

a dielectric member;

magnetic structures; and an antenna that is biased against the dielectric member by the magnetic structures, wherein the dielectric member comprises a dielectric antenna window mounted within a conductive housing.

12. A computer, comprising:

a housing;

a display mounted within the housing, wherein the display and housing are separated by a channel;

at least one antenna in the channel;

a cover layer that covers the display;

ferromagnetic structures on the cover layer; and magnetic structures that are attracted to the ferromagnetic structures and that bias the antenna towards the cover layer.

13. The computer defined in claim 12 further comprising a plurality of magnets mounted to the housing that pull the ferromagnetic structures and the cover layer towards the housing.

14. The computer defined in claim 12 wherein the antenna comprises a cavity-backed antenna having conductive cavity walls formed on a dielectric antenna support structure.

* * * * *